US012448761B2

(12) United States Patent
Depaul et al.

(10) Patent No.: US 12,448,761 B2
(45) Date of Patent: Oct. 21, 2025

(54) STREAM REGULATOR

(71) Applicant: BWT Holding GmbH, Mondsee (AT)

(72) Inventors: Marcus Depaul, Schörfling (AT); Anton Mairhofer, Zell Am Moos (AT)

(73) Assignee: BWT Holding GmbH, Mondsee (AT)

( * ) Notice: Subject to any disclaimer, the term of this patent is extended or adjusted under 35 U.S.C. 154(b) by 323 days.

(21) Appl. No.: 18/035,076

(22) PCT Filed: Nov. 3, 2021

(86) PCT No.: PCT/EP2021/080476

§ 371 (c)(1),
(2) Date: May 2, 2023

(87) PCT Pub. No.: WO2022/096488

PCT Pub. Date: May 12, 2022

(65) Prior Publication Data

US 2023/0332388 A1 Oct. 19, 2023

(30) Foreign Application Priority Data

Nov. 4, 2020 (DE) ..... 10 2020 129 021.7

(51) Int. Cl.
*E03C 1/08* (2006.01)

(52) U.S. Cl.
CPC ..... *E03C 1/08* (2013.01)

(58) Field of Classification Search
CPC . E03C 1/05; E03C 1/084; E03C 1/086; E03C 1/08
See application file for complete search history.

(56) References Cited

U.S. PATENT DOCUMENTS 2,811,340 A * 10/1957 Aghnides ..... E03C 1/084 239/581.1
2,832,643 A * 4/1958 Bletcher ..... G05D 7/0146 141/286
3,286,935 A * 11/1966 Corlett ..... E03C 1/084 239/440
3,884,418 A * 5/1975 Ritzenthaler ..... E03C 1/084 239/428.5
4,221,337 A * 9/1980 Shames ..... E03C 1/084 137/625.48
5,348,231 A * 9/1994 Arnold ..... E03C 1/084 239/447
5,549,822 A * 8/1996 Ferguson ..... B05B 15/20 210/287
7,581,685 B2 * 9/2009 Belisle ..... B05B 1/1609 239/443

(Continued)

FOREIGN PATENT DOCUMENTS

AT 190872 B 7/1957
CN 104941825 A 9/2015

(Continued)

*Primary Examiner* — Joseph A Greenlund
(74) *Attorney, Agent, or Firm* — Smartpat PLC

(57) ABSTRACT

The disclosure relates to a stream regulator for the outlet of a water faucet or of a beverage dispenser, the stream regulator comprising an outer sleeve and a conical insert seated in the sleeve. An annular passage which provides the outlet is located between the insert and the sleeve. An expansion cavity which extends around the insert is located between an inlet and the annular passage.

13 Claims, 7 Drawing Sheets

(56) References Cited

U.S. PATENT DOCUMENTS

| | | | | |
|---|---|---|---|---|
| 10,041,235 | B2 * | 8/2018 | Stein | E03C 1/086 |
| 2009/0154524 | A1 * | 6/2009 | Girelli | E03C 1/0404 4/597 |
| 2012/0325933 | A1 * | 12/2012 | Blum | E03C 1/08 239/428.5 |
| 2015/0273498 | A1 * | 10/2015 | Yaita | E03C 1/102 239/398 |
| 2017/0138026 | A1 * | 5/2017 | Huang | E03C 1/084 |
| 2017/0152651 | A1 * | 6/2017 | Staedtler | E03C 1/08 |
| 2017/0335980 | A1 * | 11/2017 | Cutler | B05B 1/1618 |
| 2023/0332388 | A1 * | 10/2023 | Depaul | E03C 1/08 |

FOREIGN PATENT DOCUMENTS

| | | | |
|---|---|---|---|
| DE | 20022166 | U1 | 6/2001 |
| DE | 102010007871 | A1 | 8/2011 |
| DE | 202015103996 | U1 | 8/2015 |
| DE | 102014006216 | A1 | 11/2015 |
| DE | 202015007873 | U1 | 6/2016 |

* cited by examiner

STREAM REGULATOR

CROSS-REFERENCE TO RELATED APPLICATION

This application is a national stage application, filed under 35 U.S.C. § 371, of International Patent Application No. PCT/EP2021/080476, filed on 3 Nov. 2021, which claims the benefit of German Patent Application No. 10 2020 129 021.7, filed 4 Nov. 2020.

TECHNICAL FIELD

The disclosure relates to a stream regulator which is designed for the outlet of a water faucet and/or of a machine for preparing beverages. More particularly, the disclosure relates to a stream regulator through which carbonated water is dispensed as well. The disclosure furthermore relates to a water faucet, a water dispenser or a machine for preparing beverages equipped with the stream regulator according to the disclosure.

BACKGROUND

Stream regulators are known to be attachments, for example on a water faucet or on a water dispenser, that define the so-called "point of use," i.e., the water outlet.

It is desirable for the water outlet to dispense a most uniform stream possible, which splashes as little as possible when it hits a container or a sink below the outlet.

Stream regulators of this type are often also used to save water and include a throttling means.

What is known from practice are so-called stream regulators, which are provided as stream regulators on most water faucets in the household.

They are usually based on the principle that the water is passed through two strainer screens with an air gap therebetween.

The strainer screens homogenize the water stream, and the air gap causes the water to become mixed with air, so that, among other things, the mass of the stream decreases in relation to its diameter.

Such measures can reduce the tendency of the water stream to splash when it hits a surface.

However, this does not always work optimally, depending on the boundary conditions, i.e., in particular with regard to water temperature and flow rate.

This is especially true for carbonated water. Outgassing of carbonic acid seems to cause a more turbulent flow, which in turn seems to increase the tendency to splash.

In addition, a water outlet from which carbonated water is dispensed tends to drip, since the residual amount present in the connection piece is pressed out by the carbonic acid.

SUMMARY

The invention is based on the object to provide a stream regulator in which the drawbacks of the prior art as mentioned above are at least mitigated. More particularly, it is an object of the invention to provide a stream regulator which reduces splashing when the water stream hits a surface and/or which is visually appealing, in particular by having the most circular-cylindrical, uniform appearance possible.

The object is achieved by a stream regulator as claimed.

Preferred embodiments and refinements of the invention will be apparent from the subject-matter of the dependent claims, the description, and the drawings.

The disclosure relates to a stream regulator for the outlet of a water faucet or beverage dispenser.

More particularly, the disclosure relates to a stream regulator which is used for a beverage dispenser, in particular a water dispenser, which is also adapted to dispense water enriched with carbonic acid as well.

More generally, the disclosure relates to a stream regulator which can also be used for all types of fittings. For this purpose, the stream regulator may, for example, be provided with a standard internal thread or external thread (e.g., M16-M24) and can be used instead of a conventional stream regulator which is designed to enrich the stream with air.

The stream regulator comprises an outer sleeve and an insert seated in the sleeve.

The insert is in particular aligned coaxially with the sleeve.

Between the insert and the sleeve, there is an annular passage which provides the outlet.

The term "annular passage" is understood to include an outlet which is only partially in the form of a ring, i.e. in particular a ring segment, or which is subdivided into ring segments.

Preferably, however, the outlet is an uninterrupted annular passage, that is to say a annular passage without webs extending therethrough.

An expansion cavity is provided between an inlet of the stream regulator and the annular passage, which expansion cavity extends around the insert. The expansion cavity may in particular have an annular shape.

The term "expansion cavity" is understood to mean a section in the flow path, where the overall cross section of the flow path between the inlet and the outlet of the stream regulator is increased compared to a previous section, in particular in the inlet area.

The expansion cavity is in particular provided between a passage at the inlet which has a smaller overall cross section and which can also be considered as the inlet for the expansion cavity, and the outlet.

Expansion cavities are usually used to influence the flow behavior of gases which, unlike water, are compressible.

In contrast to a gas, and at least if no carbonated water is used, the liquid can in fact not increase appreciably in volume in the stream regulator.

However, by providing an expansion cavity, the pressure within the expansion cavity can be kept very low as far as to the outlet, in particular it can be reduced to nearly atmospheric pressure, as the water accelerates in the area of the inlet before being introduced into the expansion cavity, due to the small cross section of an inlet to the expansion cavity.

So, the inlet to the expansion cavity has a smaller cross section than a water inlet of the stream regulator (e.g. a screw connection) as well as a smaller cross section than the expansion cavity.

The stream regulator may in particular be designed such that when the applied line pressure is 5 bar, the pressure within the expansion cavity is less than 1.5 bar (under standard conditions and a water temperature of 20° C.).

At the same time, the arrangement of the expansion cavity around the insert provides for a compact design.

Thus, the stream regulator can in particular be provided in the form of an essentially circular-cylindrical sleeve. In terms of its dimensions, it need not differ significantly from a conventional stream regulator.

In particular, the diameter to height ratio of the sleeve can be greater than 1.

Due to the smaller cross section upstream of the expansion cavity, the water is directed into the expansion cavity at a high rate, depending on the line pressure applied.

Inside the expansion cavity, the flow slows down to form a turbulent flow.

Due to the low pressure, the turbulent flow can in turn be easily retransformed into a laminar flow on the outlet, in particular by using an inner sleeve with a conically shaped collar which extends around a conically shaped head portion of the insert.

Hence, according to one embodiment, the insert has a conically tapering shape.

It has been shown that the use of a stream regulator according to the disclosure allows to generate a laminar water stream which has low tendency to splash even without being mixed with air.

This is in particular due to the low velocity of the exiting stream which is guided as a laminar flow by the surrounding air, at least within the first few centimeters after leaving the stream regulator.

According to a preferred embodiment, the insert is in the form of a flow restrictor.

That is, the minimum cross section of the stream regulator decreases compared to the cross section of the connection piece to the water pipe for which the stream regulator is used.

According to one embodiment, the inlet leads through a central passage which leads into an annular passage that extends in the opposite direction by extending upwardly between the central passage and the insert.

In this embodiment, the insert is therefore cap-shaped, having a blind hole into which the central passage protrudes, and thus cooperates with the insert to establish a flow reversal.

The water is therefore directed to the bottom of the insert, then it is directed upwards, in particular through an annular passage, and then enters the expansion cavity provided around the annular passage.

This embodiment is particularly advantageous for dispensing carbonated water.

In another embodiment, which may however also be combined with the embodiment described above, the water is directed into the expansion cavity through a lateral inlet, in particular through an annular passage, or from above.

Especially in the case of a 3-way fitting, dripping is usually also prevented by a negative pressure that arises in the fitting. Therefore, the embodiment in which water is directed into the expansion cavity through the lateral inlet is particularly suitable for such a fitting.

The inlet piece may in particular comprise a plate which defines a gap, in particular an annular gap, adjacent to the inner surface of the sleeve. The annular gap may in particular be defined by a plurality of circumferentially distributed inlet openings.

This plate is effective to homogenize the pressure distribution of the water flowing into the stream regulator, in particular if it is structured, especially if it has webs.

This is particularly advantageous when there are flow deflecting means such as elbows directly in front of the outlet.

Between an area having a minimum cross section at or downstream of the inlet and compared to an area of the expansion cavity with a maximum cross section, the cross-sectional area preferably increases at least twice, most preferably at least 5 times and/or less than 100 times, more preferably less than 50 times.

According to one embodiment, the outlet comprises a ring with axially extending spacers for the insert.

The spacers may in particular be in the form of webs circumferentially distributed around a collar, in particular a conical collar.

It is in particular contemplated for the stream regulator to comprise an outer sleeve, an inner sleeve, the insert, and an inlet piece, and these components are captured within the outer sleeve and positioned relative to one another by spacers that are integral with the respective components.

Thus, a material bond between the components can be dispensed with, and the stream regulator can be produced in a simple manner.

In a preferred embodiment, downstream of the expansion cavity in terms of the flow direction, in particular downstream of an area of the expansion cavity having a maximum cross-sectional area, the cross-sectional area decreases towards the outlet down to a minimum cross-sectional area which can in particular amount to 0.1-0.8 times the maximum cross-sectional area in the expansion cavity.

This reduction in cross section may in particular be implemented by a decreasing diameter of an annular passage provided between the sleeve and the insert, which initially defines the expansion cavity, by the insert having a conically shaped head portion which faces a conically tapering collar of the sleeve, which defines the front end of the sleeve.

This promotes the formation of a laminar flow on the outlet end, with still low velocity.

The sleeve may have an outer diameter between 10 and 40 mm, preferably between 15 and 25 mm.

However, for applications in particular in the industrial sector it is also possible to provide a correspondingly larger stream regulator as well.

According to one refinement, the stream regulator comprises a UV light source. It may be arranged in the inlet piece, for example, and serves to disinfect the stream regulator or the residual water adhering inside the stream regulator.

In general, the stream regulator according to the disclosure is superior to known stream regulators from a hygienic point of view, since the total surface area is significantly smaller compared to stream regulators which have honeycomb or grid type screen surfaces, for example.

The stream regulator may in particular be dimensioned such that with a pressure of 6 bar at the inlet, the Reynolds number Re of the exiting water is less than 2,300, preferably less than 2,000, for water at 20° C., for water at 20° C. with 6 g/l of carbon dioxide, as well as for water at 60° C. (and otherwise under standard conditions).

In this way it was possible for the first time to provide a stream regulator that is equally suitable for warm water, in particular even for water that is used to prepare tea and may have 80° C. or more, and which can at the same time also be used for carbonated water.

At the same time, due to the laminar flow, preferably without the addition of air, a visually appealing crystal-clear appearance of the emerging stream is achieved.

The stream regulator according to the disclosure can be used, for example, for water dispensers, for machines for preparing beverages, in particular for preparing hot and cold beverages.

The disclosure also relates to a water faucet, to a water dispenser, and to a machine for preparing beverages, which comprise the stream regulator as described above.

Preferably, the stream regulator is connected to a fitting or to a machine-side water outlet through a threaded connection.

BRIEF DESCRIPTION OF THE DRAWINGS

The subject-matter of the invention will now be explained with reference to an exemplary embodiment illustrated in the drawings of FIGS. 1 through 12.

DETAILED DESCRIPTION

Figure 1:
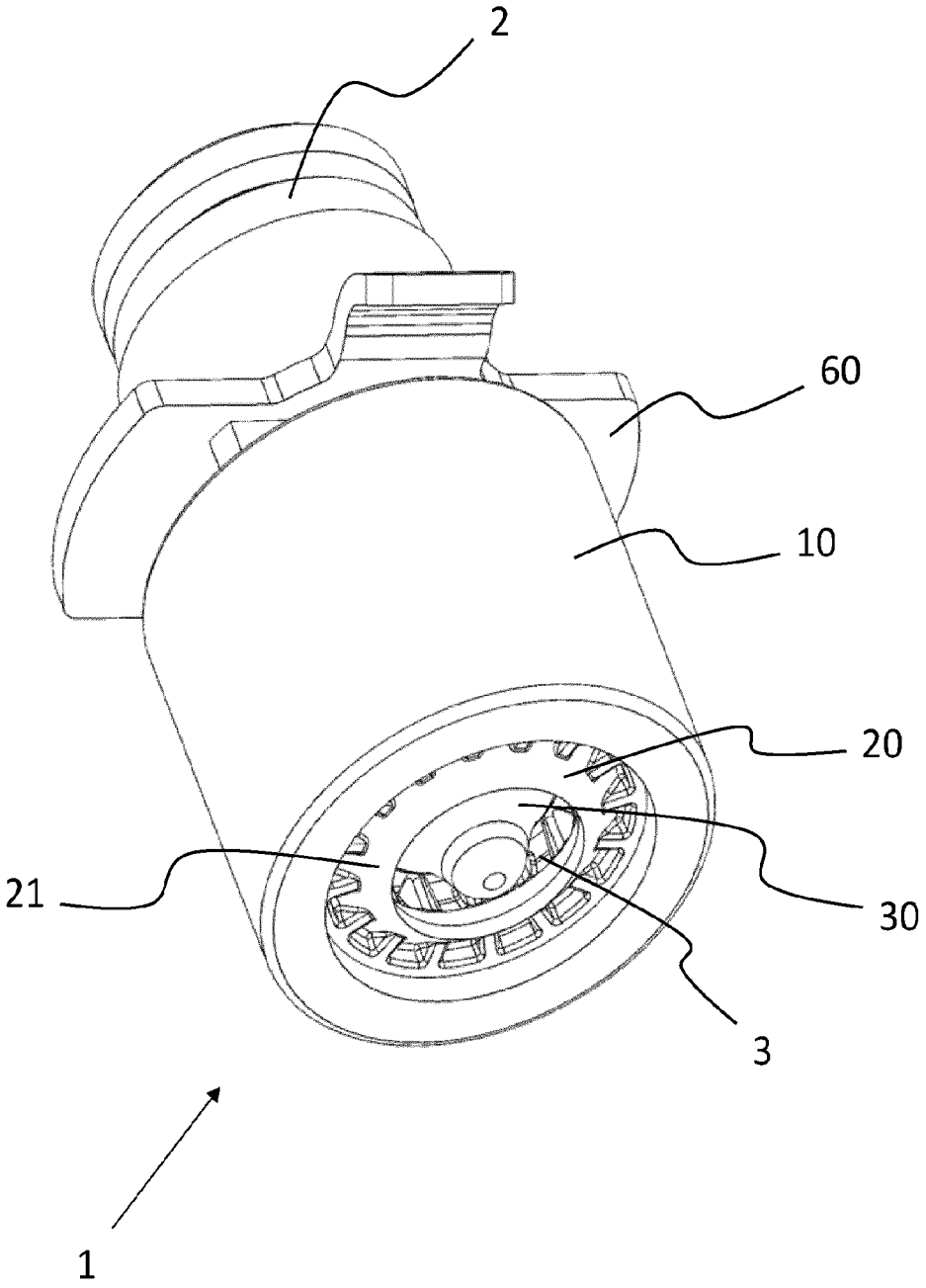
FIG. 1 is a perspective view of an exemplary embodiment of a stream regulator.

FIG. 1 is a perspective view showing an exemplary embodiment of a stream regulator 1 that is connected to a water connection 2.

The water connection 2 may, for example, form part of a water dispenser or of a machine for preparing beverages, or may be the end piece of a water faucet.

Such outlets are usually tubular and dispense a turbulently flowing inhomogeneous stream of water which, among other things, has a strong tendency to splash when it hits an adjacent surface.

The purpose of the stream regulator 1 is to transform the exiting water into a visually appealing, most circular-cylindrical stream possible, with only slight tendency to splash when it hits a surface.

At the same time, a purpose of the stream regulator 1 may be to serve as a throttle or flow restrictor to reduce the flow rate when the water faucet is opened so as to contribute to saving water.

In this exemplary embodiment, the stream regulator 1 comprises an upper piece 60 for being mounted to the water connection 2, which is in the form of a grip portion that allows to easily mount the stream regulator 1.

In another embodiment, not shown here, the entire stream regulator 1 has a substantially circular-cylindrical shape and thus in particular serves to replace conventional stream regulators on a water faucet.

The stream regulator 1 has a sleeve-like outer contour.

In this exemplary embodiment, the sleeve comprises an outer sleeve 10 and an inner sleeve 20.

Through an annular passage 3, the stream regulator 1 dispenses a homogeneous water stream with a laminar flow.

The annular passage 3 is defined between an insert 30 that has a conical head portion and a collar 21 that is arranged coaxially thereto and defines the front end surface of the inner sleeve 20.

The collar 21 conically tapers toward the front end, at least the inner surface thereof, preferably substantially parallel to the opposing surface of the insert 30, which has a conical shape at its front end.

The annular passage 3, the end of which defines the outlet, thus has a shape that is conically tapering towards the front end.

Due to the diameter decreasing towards the front end (front, i.e. downstream, and rear, i.e. upstream relating to the flow direction), the total cross section of the annular passage 3 decreases towards the front end, which contributes to the formation of a laminar flow.

Figure 2:
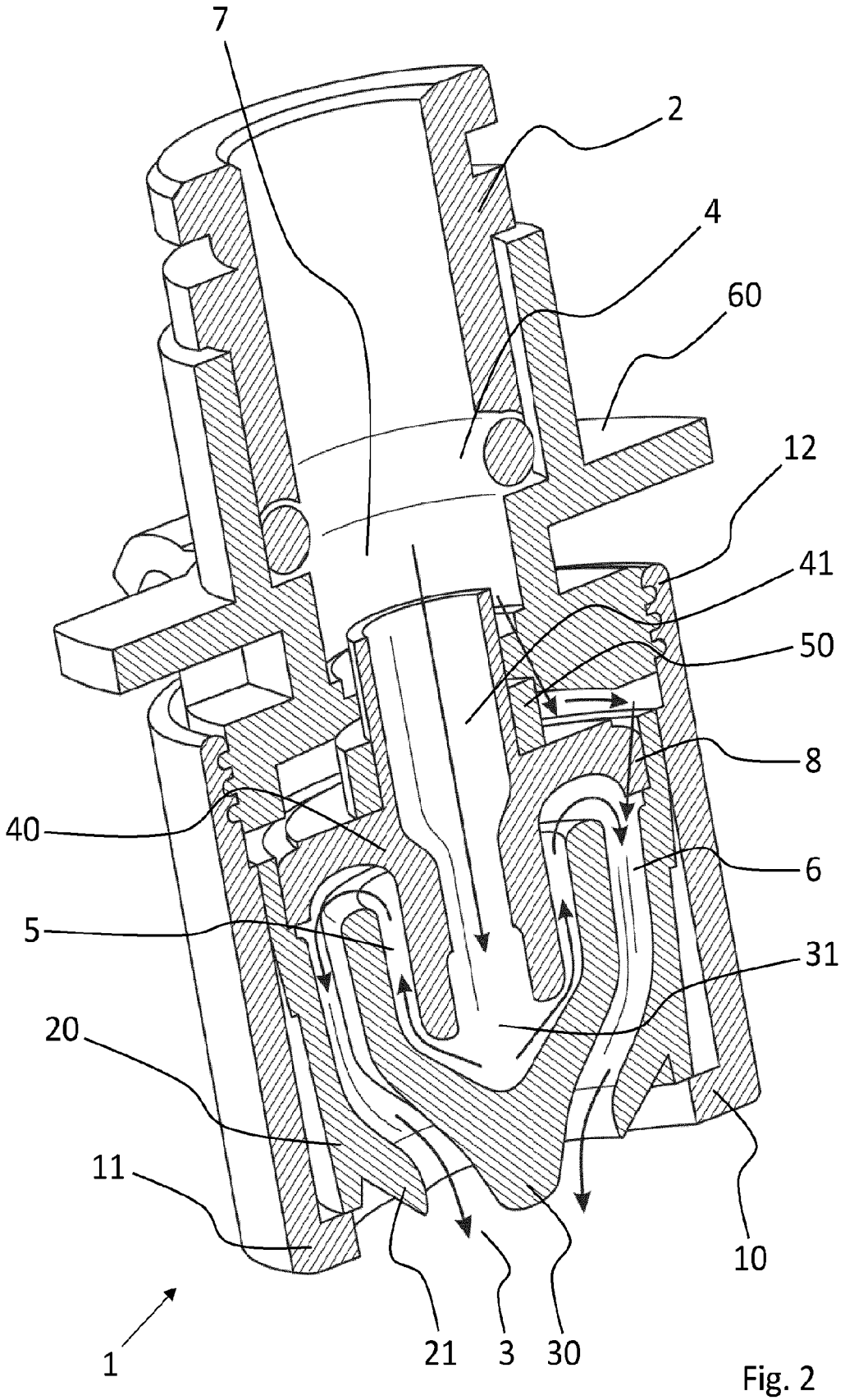
FIG. 2 is a longitudinal sectional view of the stream regulator.

FIG. 2 is a longitudinal sectional view of the stream regulator 1, including the water connection 2. This view illustrates all of the components of the stream regulator 1.

The possible water flow is indicated by arrows.

The stream regulator 1 is connected to the water connection 2 by the upper piece 60.

In the embodiment illustrated here, the water enters an expansion cavity 6 via two flow paths. In other embodiments (not shown), the stream regulator is designed such that the water enters the expansion cavity 6 only via one of the flow paths illustrated.

A seal 4 is arranged between the water connection 2 and the upper piece 60.

Downstream of the upper piece 60, an inlet piece 40 is arranged, which serves to direct the water into the expansion cavity 6.

Depending on the embodiment, the upper piece 60 and the inlet piece 40 may also be formed integrally, i.e. as a single component.

Through the inlet 7, the water flows through the stream regulator 1 in the form of a sleeve and leaves the stream regulator 1 at the outlet 3.

In this exemplary embodiment, the sleeve comprises an outer sleeve 10 and an inner sleeve 20.

The outer sleeve 10 is connected to the upper piece 60 by a thread 12.

The stream-forming components of the stream regulator 1 are sequentially arranged between the upper piece 60 and a front end collar 11 of the outer sleeve 10.

The end face of the inner sleeve 20 bears against the collar 11 of the outer sleeve 10.

All of these components are preferably inserted into the outer sleeve 10 without having to be welded or bonded to one another.

The outer sleeve 10 may be made of metal or plastics material.

The other components of the stream regulator 1, in particular the insert 30 and the inlet piece 40 are preferably in the form of plastic injection molded parts.

The water flowing in from the inlet 7 is directed through the inlet piece 40 and into the expansion cavity 6, and, in particular depending on the embodiment, two flow paths are possible, which may however also be combined with one another, as shown here.

The expansion cavity 6 is in the form of an annular passage which is located between the coaxial insert 30 and the sleeve, more precisely the inner sleeve 20.

In order to obtain a turbulent flow with low pressure inside the expansion cavity 6, it is necessary to introduce the water flowing into the expansion cavity 6 at a highest possible velocity.

In the embodiment illustrated here, two flow paths are provided for this purpose.

On the one hand, inflowing water can reach the expansion cavity 6 via a lateral inlet 8.

For this purpose, the inlet piece 40 may be formed with one or more lateral openings, so that water can flow into the expansion cavity 6 via a lateral inlet 8 which comprises a plurality of circumferentially distributed openings.

This flow control is particularly well suited when no carbonated water is to be dispensed.

In particular in the case of carbonated water, however, the latter flows into the expansion cavity 6 through an inner passage 5.

In order for the water to reach the expansion cavity 6 in this way, the inlet piece 40 has a central passage 41 that is preferably aligned coaxially.

The insert 30 is cap-shaped and comprises a blind hole 30 on the inside, into which the central passage 41 opens.

The central passage 41 protrudes into the blind hole 31, so that the central passage 41 and the blind hole 31 cooperate to cause flow reversal leading into the passage 5.

In the case of carbonated water, this has the advantage that residual water can move back downwards along the blind hole 31 when the water pressure is turned off, which will generally prevent dripping at the outlet 3.

The expansion cavity 6 has an annular shape.

When the water enters the expansion cavity 6, a turbulent flow initially occurs within the expansion cavity 6, due to the relatively high velocity of the inflowing water.

Because of the larger cross-sectional area of the expansion cavity 6, the water pressure drops almost to atmospheric pressure in this area.

The annular passage of the expansion cavity 6 then continues to the outlet 3 with a section in which, due to the conical shape of the insert 30 and of the collar 21 which also tapers toward the front end, the diameter and thus also the total cross-sectional area of the annular passage continuous to gradually decrease toward the outlet 3.

In this section, the flow calms down and a laminar flow with low pressure is created.

Between the inlet 7 and the outlet 3, there are no openings along the sleeve of the stream regulator 3, through which air could enter the water flow.

Therefore, in contrast to stream regulators, the emerging stream does not have a milky, but rather a crystal-clear visual appearance and, due to the laminar flow, a circular-cylindrical shape.

Since grid-like inserts are dispensed with, the components of the stream regulator 1 have a relatively small surface area, which reduces undesirable germination.

Furthermore, the stream regulator 1 is suitable for dispensing hot water, cold water, and carbonated water.

In one embodiment not illustrated here, the stream regulator 1 can be equipped with a UV light source for killing germs.

For this purpose, components of the stream regulator, in particular the insert 30, the inner sleeve 20 and/or the inlet piece 40, can be made from a UV-transmissive material, in particular from a UV-transmissive plastics material.

In this exemplary embodiment, inlet piece 40, insert 30, and inner sleeve 20 are arranged axially one after the other, and are formed such that these components are spaced apart from one another by spacers so that the respective passages for water flow are provided.

These components are captured between a collar 11 of the outer sleeve 10, on which the inner sleeve 20 bears, and the upper piece 60 which is screwed on the opposite end.

The central passage 41 is equipped with a ring 50 on its upper side, which serves as a spacer in this embodiment.

Figure 3:
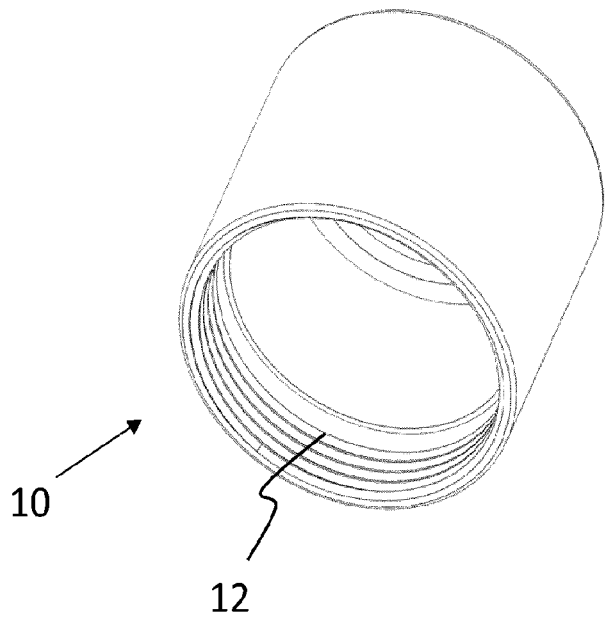
FIGS. 3 and 4 are perspective views of the outer sleeve.

FIG. 3 is a perspective view of the outer sleeve 10.

It has an internal thread 12 into which the upper piece (60) of the stream regulator is screwed.

Figure 4:
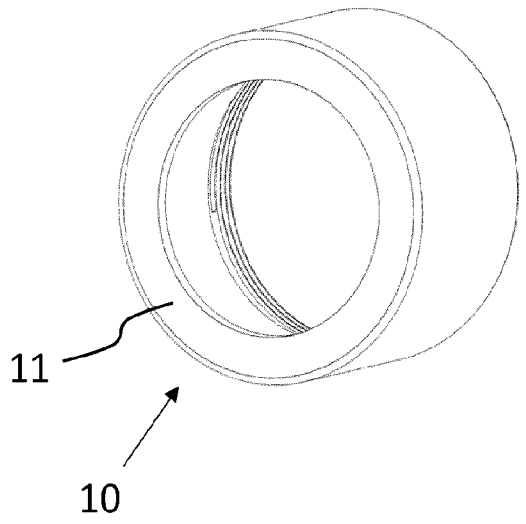

As shown in the perspective view of FIG. 4, the outer sleeve 10 has a collar 11 on its lower end, which serves as a stop for the inner sleeve (20).

Figure 5:
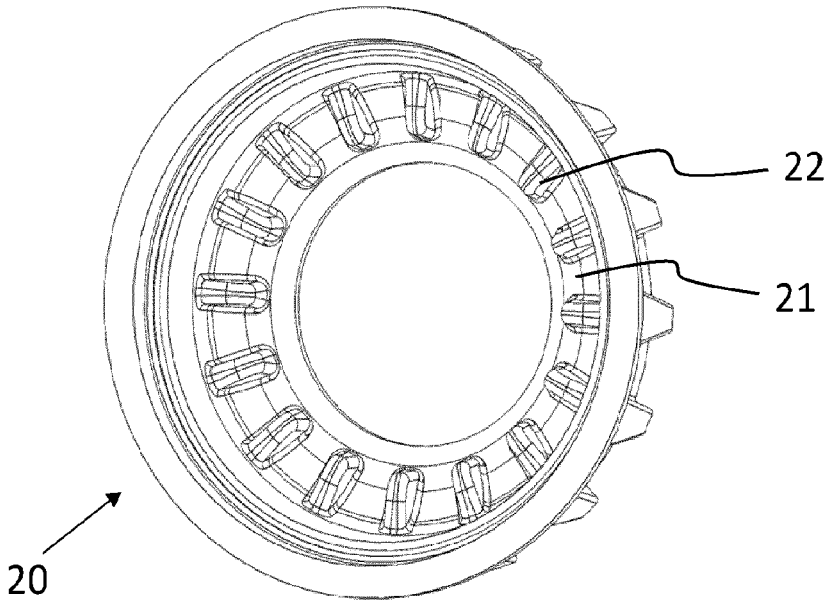
FIGS. 5 and 6 are perspective views of the inner sleeve.

FIG. 5 is a perspective view of the inner sleeve 20 viewed from the direction of flow, that is, from the upstream end.

The inner sleeve 20 is cap-shaped, with a central opening in the bottom.

Accordingly, the inner sleeve 20 has a collar 21 at its front end.

On the inside, i.e. facing the insert, the collar 21 comprises a plurality of spacers 22 which are distributed circumferentially around the collar and on which the insert (30) rests in the assembled state.

In this exemplary embodiment, the spacers 22 are in the form of axially extending webs. This can enhance the formation of a laminar flow.

Figure 6:
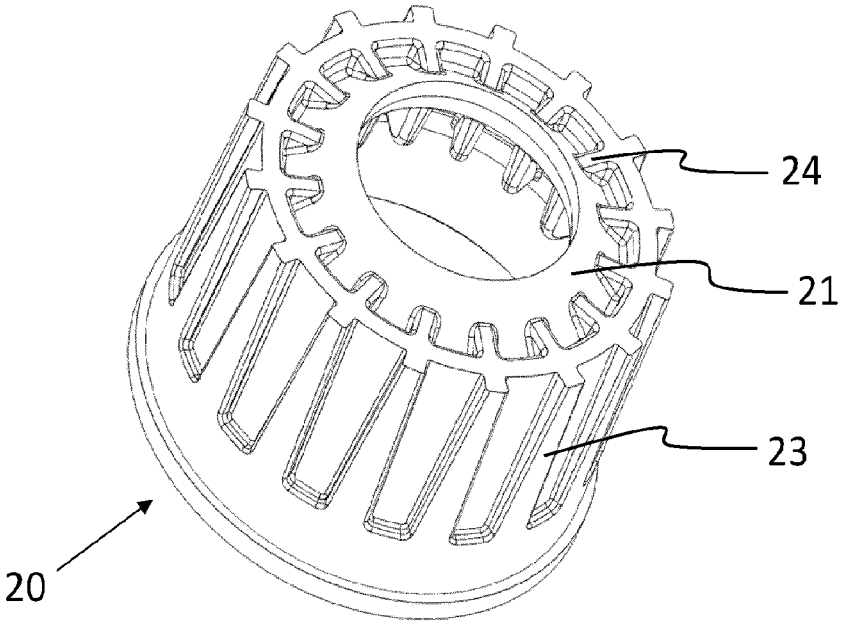

FIG. 6 is a perspective view of the inner sleeve 20 from the opposite end.

This view illustrates particularly well that the collar 21 is tapering conically toward the front end.

The lateral wall of the inner sleeve 20 extends obliquely, i.e. conically towards the front end, in particular at an angle of 2° to 8° relative to the central axis.

This configuration contributes to a gradual slight reduction in the diameter of the expansion cavity towards the outlet, which improves the formation of a laminar flow.

In order to be inserted into the outer sleeve which has a circular-cylindrical shape on the inside, axially extending webs 23 are provided on the lateral wall.

At the front end, the webs 23 merge into the conical collar 21 through cross webs 24.

This configuration has the function of a visually appealing technical appearance.

However, for directing the flow, a tapering configuration of the collar 21 on the inside is sufficient, so that in a further embodiment (not shown), the area between the cross webs 24 may also be filled with material.

Figure 7:
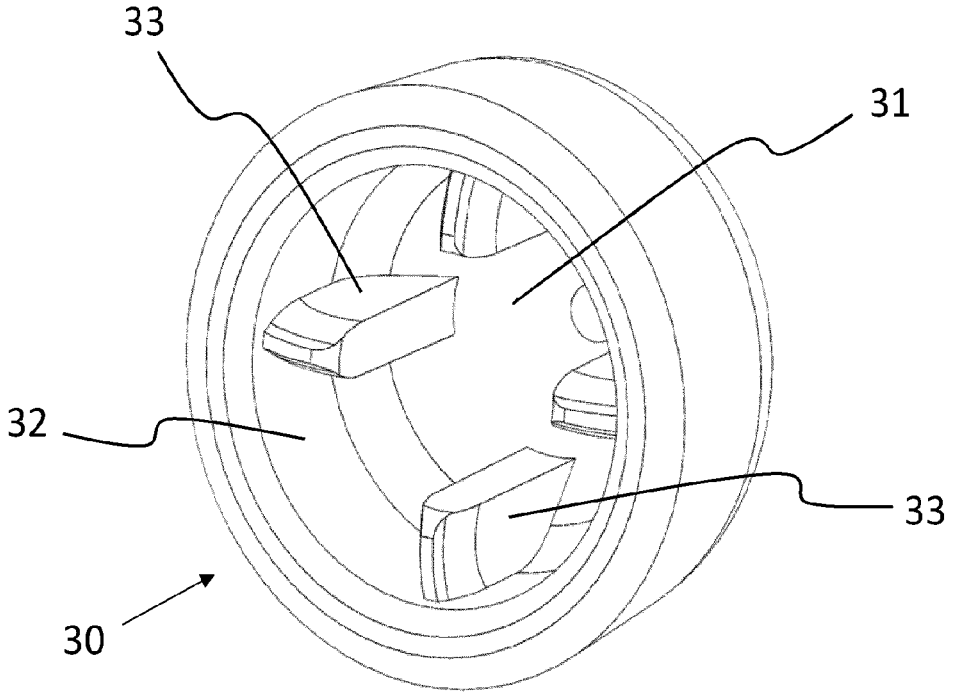
FIGS. 7 and 8 are perspective views of the insert.

FIG. 7 is a perspective view of the insert 30 as viewed from the upstream end, that is from the direction of flow.

The insert 30 comprises the blind hole 31 which is conically tapering towards the front end.

Axially extending webs 33 are distributed circumferentially around the lateral inner surface 32, serving to be fitted to the inlet piece.

Figure 8:
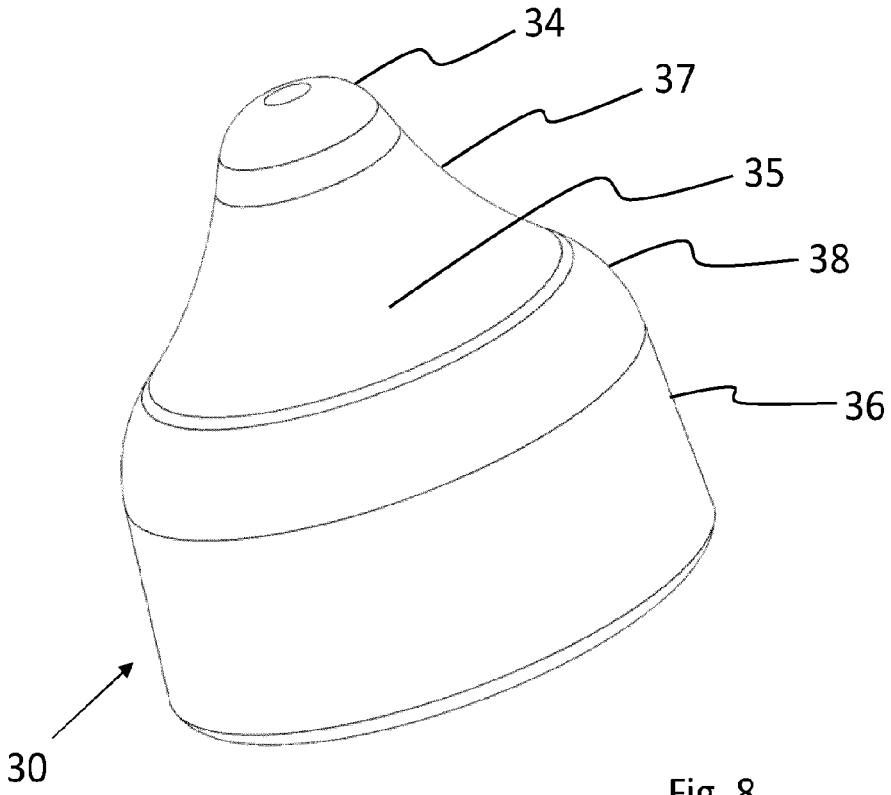

FIG. 8 is a perspective side view of the insert 30.

The insert 30 has conical shape at its front end and begins with a rounded head portion 34.

In the transition portion 35, the side wall of the insert 30 preferably extends at an angle of 30° to 60°, most preferably 40° to 50°, relative to the central axis.

However, the transition portion 35 does not exactly has the shape of a truncated cone in this exemplary embodiment, but rather has a concave portion, or indentation 37, where the angle of the lateral surface relative to the central axis varies.

The angle of the lateral surface thus becomes steeper towards the outlet, which enhances the formation of a laminar flow.

The transition portion 35 merges into a body portion 36 via a rounded portion 38.

In this exemplary embodiment, the body portion 36 tapers slightly, more particularly the lateral wall of the body portion 36 extends at an angle of 3° to 15° relative to the central axis.

The taper of the lateral wall of the body portion 36 may correspond to the taper of the lateral surface of the inner sleeve in this area.

Figure 9:
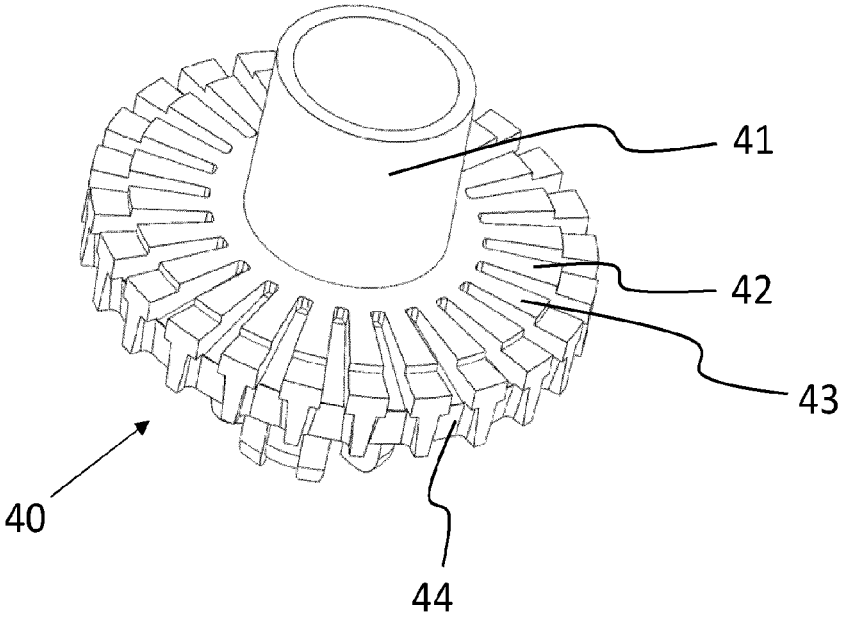
FIGS. 9 and 10 are perspective views of an inlet piece.

FIG. 9 is a perspective view of the inlet piece 40.

The inlet piece 40 has a central passage 41 which opens into the insert (30).

Upstream of the insert, the inlet piece 40 is disk-shaped and comprises the annular disk 42 which has passages 44 on its perimeter, through which part of the water can also flow directly into the expansion cavity on the edge, without flowing through the insert.

If this is not desired, the passages 44 can also be dispensed with (not shown).

The annular disk 42 may have a structure.

In this exemplary embodiment, a structure is provided by webs 43 that extend in a star shape.

This can serve to homogenize the inflowing water, in particular in the case of an inhomogeneous flow pattern in the vicinity of flow deflection.

Figure 10:
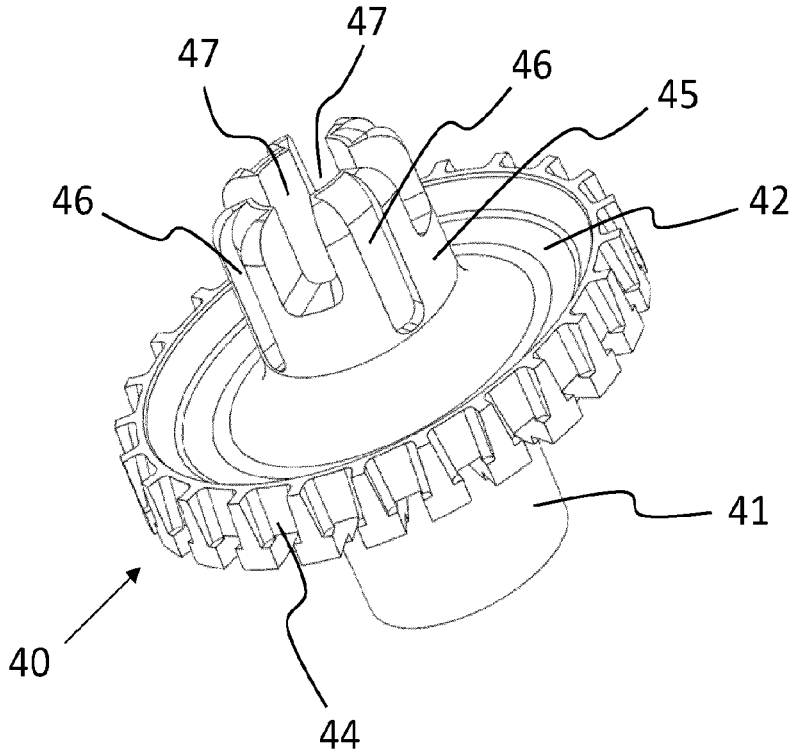

FIG. 10 is another perspective view of the inlet piece 40. In the direction of flow, the central passage 41 merges into a section comprising a coupling portion 45 which has axially extending grooves 46 and lateral recesses 47 on the front end.

The grooves 46 of the central passage are to be fitted onto the axial webs 33 shown in FIG. 7.

The lateral recesses 47 allow water to flow into the blind hole (31) of the insert.

This water will then flow (through the passage 5) upwards to the annular disk 42, from where it is introduced into the expansion cavity from the inside.

The inner end wall of the annular disk 42, i.e. facing away from the flow, thickens outwards, thus cooperating with the opposing wall of the insert to form a curved passage through which the water enters the expansion cavity.

Figure 11:
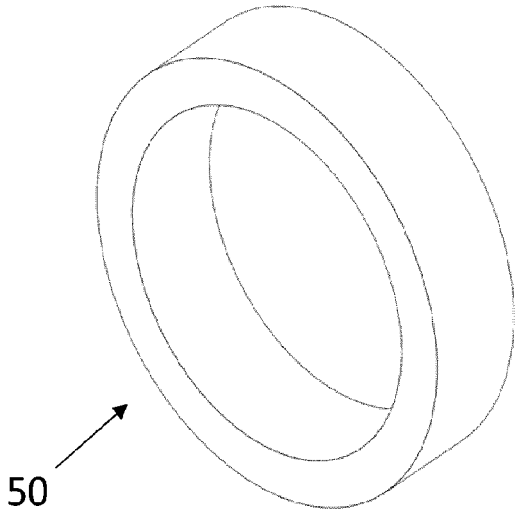
FIG. 11 is a perspective view of a ring that holds the components of the stream regulator in place.
Figure 12:
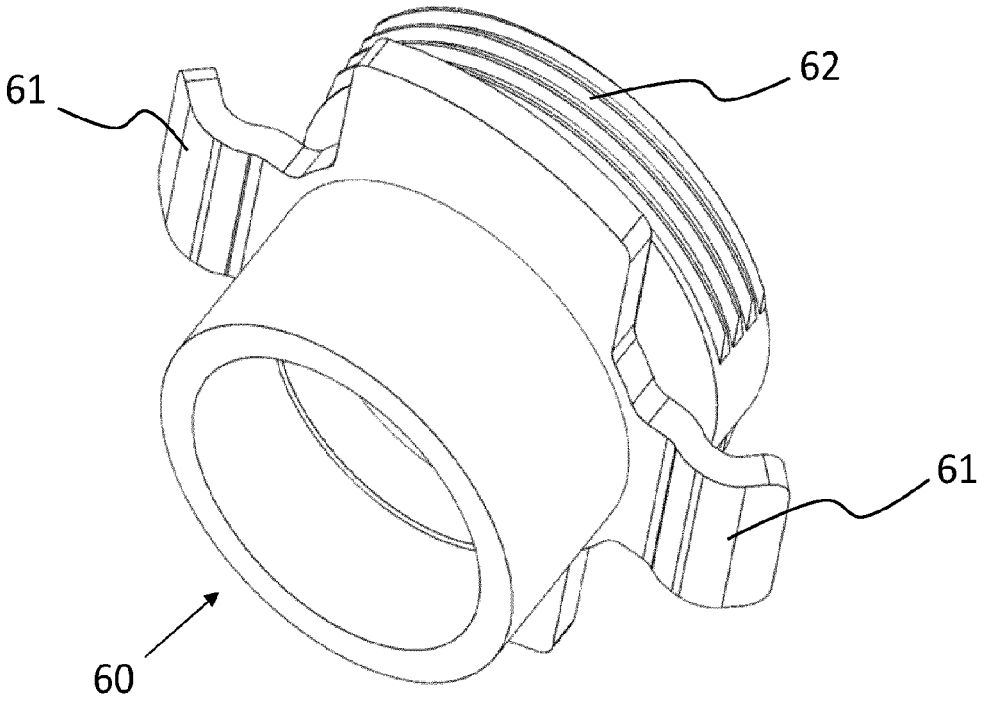
FIG. 12 is a perspective view of the upper piece of the stream regulator.

FIG. 11 is a perspective view of the ring 50 which serves as a spacer between the inlet piece and the upper piece 60 shown in FIG. 12.

The upper piece 60 has a thread 62 which serves to connect the upper piece 60 to the outer sleeve.

Furthermore, radially protruding grip portions 61 are provided in this exemplary embodiment, which make it easier to screw-in the stream regulator.

The invention made it possible to provide a stream regulator which is in particular also suitable for carbonated and hot water as well. The stream regulator allows to provide a visually appealing stream with low tendency to splash in a surprisingly simple and efficient manner.

LIST OF REFERENCE NUMERALS

1 Stream regulator
2 Water connection
3 Annular passage/outlet
4 Seal
5 Passage
6 Expansion cavity
7 Inlet
8 Lateral insert
10 Sleeve
11 Collar
12 Thread
20 Inner sleeve
21 Collar
22 Spacer
23 Axial web
24 Cross web
30 Insert
31 Blind hole
32 Inner surface
33 Web
34 Head portion
35 Transition portion
36 Body portion
37 Indentation
38 Rounded portion
40 Inlet piece
41 Central passage
42 Annular disk
43 Web
44 Passage
45 Coupling portion
46 Groove
47 Recess
50 Ring
60 Upper piece
61 Grip portion
62 Thread

The invention claimed is:

1. A stream regulator (1) for an outlet of a water faucet or of a beverage dispenser, comprising:
a sleeve (20);
an insert (30) seated in the sleeve (20);
an annular passage (3) located between the insert (30) and the sleeve (20), the annular passage (3) forming the outlet of the water faucet or the beverage dispenser; and
an expansion cavity (6) located between an inlet (7) and the annular passage (3), the expansion cavity (6) having an increasing cross sectional area along a flow path between the inlet and the outlet,
wherein the expansion cavity extends around the insert, and
wherein, downstream of the expansion cavity (6) a cross-sectional area of the annular passage (3) decreases towards the outlet (3),
wherein this decrease towards the outlet (3) is implemented by a decreasing diameter of the annular passage (3) between an inwardly conically tapering collar (21) at a front end of the sleeve (20) and a conically shaped head portion of the insert (30),
wherein the conically shaped head portion faces the conically inwardly tapering collar (21), and
wherein no openings through which air could enter a water flow are present between the inlet (7) and the outlet (3).

2. The stream regulator as in claim 1, wherein the insert has a conically tapering shape.

3. The stream regulator as in claim 1, wherein the outlet comprises a ring with axially extending spacers for the insert.

4. The stream regulator as in claim 1, wherein a lower end of the annular passage directly forms an unobstructed opening for a liquid.

5. The stream regulator as in claim 1,
wherein the sleeve has a diameter between 10 and 40 mm.

6. The stream regulator as in claim 1,
wherein the sleeve has a diameter between 15 and 25 mm.

7. The stream regulator as in claim 1,
wherein that the stream regulator comprises a UV light source.

8. The stream regulator as in claim 1, wherein the inlet is in communication with the expansion cavity through a flow reversal section.

9. A water faucet and/or water dispenser and/or machine for preparing beverages, comprising the stream regulator according to claim 1.

10. A stream regulator (1) for
an outlet of a water faucet or of a beverage dispenser, comprising:
a sleeve (20);
an insert (30) seated in the sleeve (20);
an annular passage (3) located between the insert (30) and the sleeve (20), the annular passage (3) forming the outlet of the water faucet or the beverage dispenser; and an expansion cavity (6) located between an inlet (7) and the annular passage (3), the expansion cavity (6) having an increasing cross sectional area along a flow path between the inlet and the outlet, wherein the expansion cavity extends around the insert, and wherein, downstream of the expansion cavity (6) a cross-sectional area of the annular passage (3) decreases towards the outlet (3), and wherein this decrease towards the outlet (3) is implemented by a decreasing diameter of the annular passage (3) between a conically tapering collar (21) at a front end of the sleeve (20) and a conically shaped head portion of the insert (30), and wherein the inlet is a flow restrictor in form of a central passage which leads into the annular passage, and wherein directions of flow of a liquid in the central passage and in the annular passage are opposite, and wherein a direction of flow in the annular passage extends upwards between the central passage and the insert.

11. The stream regulator as in claim 10, wherein the central passage has a collar which extends radially outwards on an inlet side.

12. The stream regulator as in claim 10, wherein the central passage has a collar which defines the annular passage between the sleeve and the collar, and wherein the collar has a conically tapering shape towards a front end.

13. A stream regulator (1) for an outlet of a water faucet or of a beverage dispenser, comprising:

a sleeve (20);

an insert (30) seated in the sleeve (20); an annular passage (3) located between the insert (30) and the sleeve (20), the annular passage (3) forming the outlet of the water faucet or the beverage dispenser; and an expansion cavity (6) located between an inlet (7) and the annular passage ( 3), the expansion cavity (6) having an increasing cross sectional area along a flow path between the inlet and the outlet, wherein the expansion cavity extends around the insert, and wherein, downstream of the expansion cavity (6) a cross-sectional area of the annular passage (3) decreases towards the outlet (3), and wherein this decrease towards the outlet (3) is implemented by a decreasing diameter of the annular passage (3) between a conically tapering collar (21) at a front end of the sleeve (20) and a conically shaped head portion of the insert (30), and wherein the stream regulator is dimensioned such that with a pressure of 6 bar at the inlet, the Reynolds number (Re) of a laminar flow of a liquid through the annular passage (3) is less than 2000 for water at 20° C. with 6 g/l of carbon dioxide.

* * * * *